US005080315A

United States Patent [19]

Tucker-Schafer

[11] Patent Number: 5,080,315

[45] Date of Patent: Jan. 14, 1992

[54] WORK STATION ORGANIZER AND COPYHOLDER

[76] Inventor: Pamela L. Tucker-Schafer, 3911 N. Howard, Spokane, Wash. 99205

[21] Appl. No.: 594,646

[22] Filed: Oct. 9, 1990

[51] Int. Cl.[5] ..... A47B 19/00

[52] U.S. Cl. ..... 248/441.1; 211/11; 248/447.1; 248/454

[58] Field of Search ..... 248/465, 442.2, 441.1, 248/456, 451, 452, 453, 454; 447.1; 211/10, 11, 69.1; 400/718

[56] References Cited

U.S. PATENT DOCUMENTS 470,207 3/1892 Morrison ..... 248/454

4,700,829 10/1987 Goodyear ..... 211/11 X

FOREIGN PATENT DOCUMENTS 41311 of 1913 United Kingdom ..... 248/447.1

*Primary Examiner*—David L. Talbott

*Attorney, Agent, or Firm*—John A. Beehner

[57] ABSTRACT

A work station organizer and copyholder having storage compartments for file folders and task related items that includes a support base having a bottom surface and front and rear portions. The front portion is formed into at least one compartment having a top opening adapted to secure task related items, and the rear portion having first and second upstanding portions forming a channel adapted to removably support file folders and the like. Also included is a generally vertical support member having a lower end portion secured to the support base and a upper end portion connected to a document support panel adapted to support copy and the like. The document support member is rotatably secured to the upper end portion of the generally vertical support member via joint means that allows for rotation of the document support member about at least two axes.

11 Claims, 2 Drawing Sheets

WORK STATION ORGANIZER AND COPYHOLDER

BACKGROUND OF THE INVENTION

1. Technical Field

The present invention is directed to easels and the like and more particularly to work station organizers and copyholders.

2. Description of the Prior Art

Many individuals find it necessary to read information from printed or written material while using their hands to perform work related tasks. For example, typist or data input operators are required to key in written material on a keyboard while reading from notes or the like. Likewise, cooks find it necessary to read recipes while they go about physically preparing a given entree.

Performance of activities such as these are inherently difficult in that the individual must constantly turn away from his or her task in order to receive additional information necessary to continue the performance of the task. Assignments often require the user to manipulate task related paraphernalia or tools. Such paraphernalia is often temporarily misplaced, reducing efficiency, and tending to frustrate the person required to perform the task.

Known to the art are several copyholders adapted to secure reading material at or near a user's eye level. Such copyholders consist of a base, document holder, and means for adjustably elevating copies secured to the copyholder. Many of these devices are quite elaborate while others are decidedly simple. Inmac, 2465 Augustan Drive, Santa Clara, Calif. 95052, a catalog supply house, offers a wide variety of such copyholders. All of these prior art devices are incapable of performing the objects of the present invention.

3. Objects of the Invention

Therefore, it is a principal object of the present invention to provide an improved work station organizer and copyholder.

Another object of the present invention is to provide a work station organizer and copyholder that is adapted to arrange and store task related items such as file folders, note pads, message slips, computer media, paper clips, stamps, rubber bands, letter openers, staplers, scissors, and food preparation paraphernalia and the like.

Another object of the present invention is to provide a work station organizer and copyholder that is adapted to adjustably secure copy at a users eye level thereby relieving a user of many of the difficulties inherent in transcribing or reading copy or recipes and the like.

Another object of the present invention is to provide a work station organizer and copyholder that is economical to manufacture and durable in use.

Another object of the present invention is to provide a work station organizer and copyholder that is efficient in operation and refined in appearance.

Another object of the present invention is to provide a work station organizer and copyholder that is easy to install, simple in construction, and trouble free.

Another object of the present invention is to provide a work station organizer and copyholder that is antistatic and demagnetized so that it will not damage magnetic media.

Finally, another object of the present invention is to provide a work station organizer and copyholder that reduces clutter. These and other objects will be apparent to those skilled in the art.

SUMMARY OF THE INVENTION

The work station organizer and copyholder provides storage compartments for file folders and task related items by first providing a support base having a bottom surface and front and rear portions. The support base front portion is formed into at least one compartment having a top opening adapted to secure task related items. The rear portion has a bottom wall secured to and extended rearwardly from the front portion with an upstanding rear wall extending upwardly from the bottom wall so that the bottom wall and rear wall at least partially define a channel adapted to removably support file folders and the like.

Also included is a generally vertical support member having a lower end portion secured to the support base and a upper end portion connected to a document support panel adapted to support copy and the like. The document support member is rotatably secured to the upper end portion of the generally vertical support member via joint means that allow for rotation of the document support member about at least two axes.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 1:
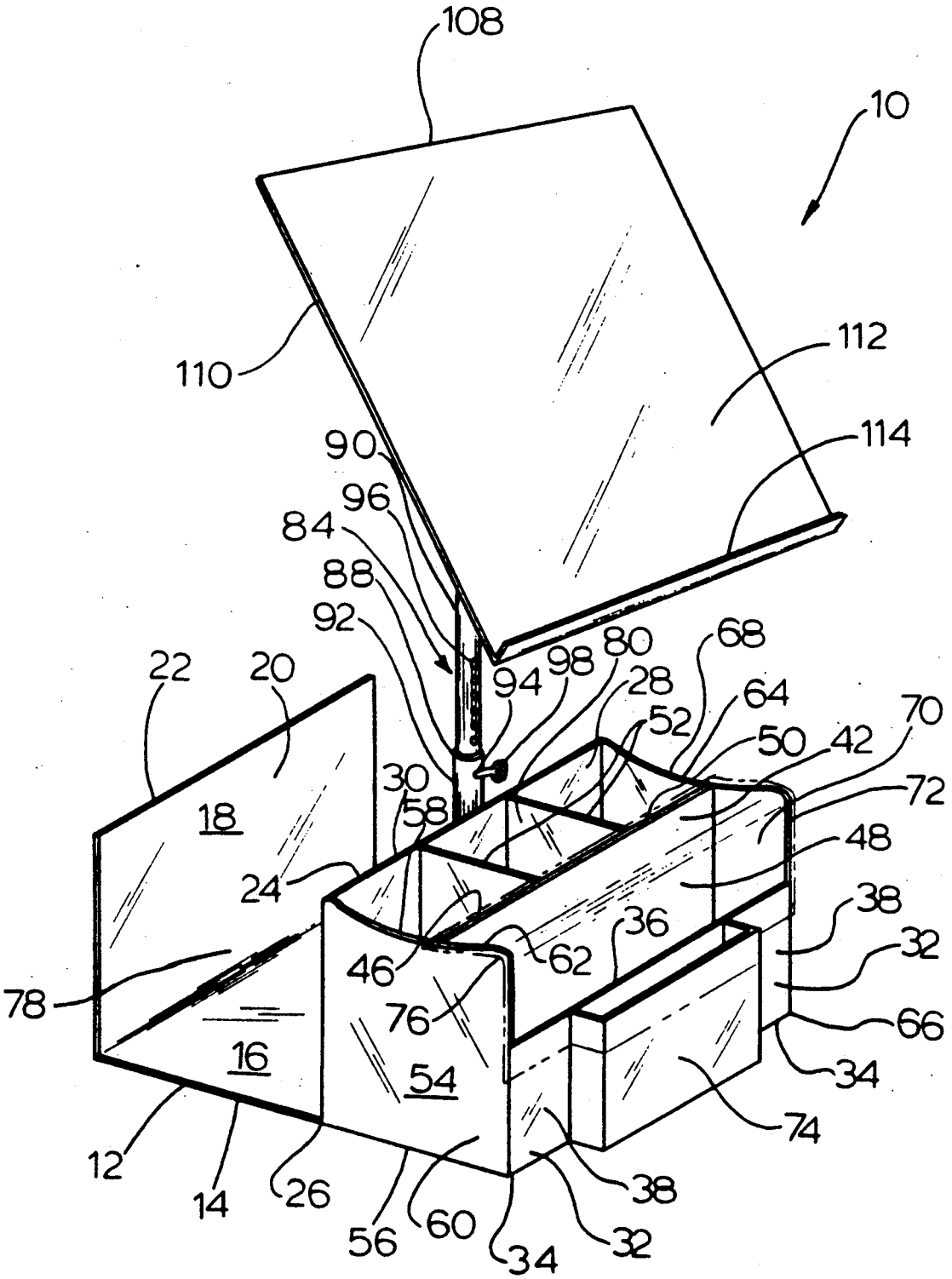
FIG. 1 is a perspective view of a preferred embodiment of the work station organizer and copyholder.
Figure 2:
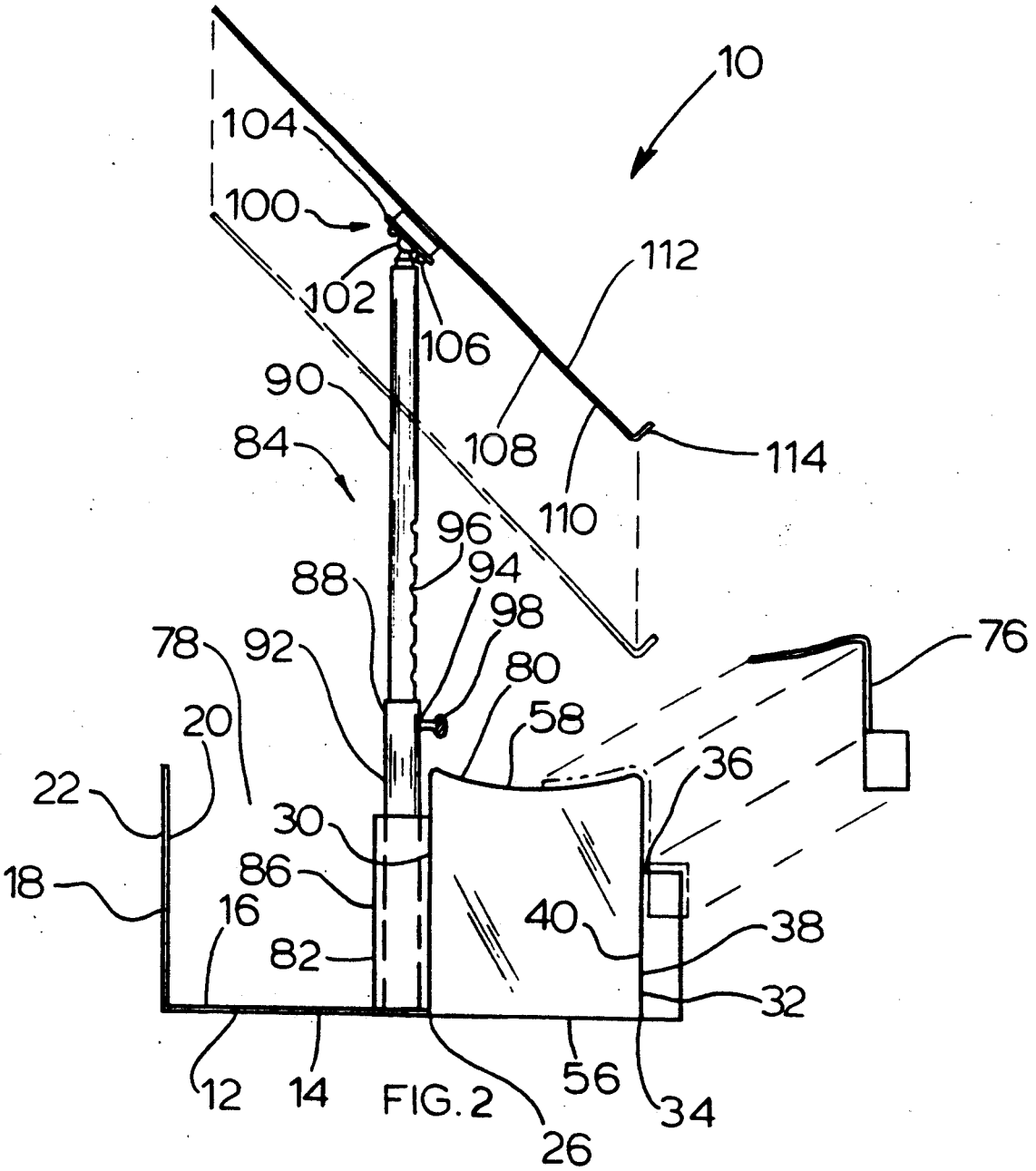
FIG. 2 is a side elevational view of a preferred embodiment of the work station organizer and copyholder showing the document support panel joint and diskette dust cover assembly.

In a preferred embodiment a base is provided with compartments for file folders and computer diskettes. Attached to the base is a document support panel that is rotatable about two axes and vertically adjustable in a single plane. The document support panel may be removed and used apart from the base. A preferred embodiment of the present invention 10 is illustrated in FIGS. 1 and 2.

In a preferred embodiment of the present invention 10 there is provided a base bottom plate 12 having both bottom 14 and top 16 surfaces. The plate 12 has first 15 and second 17 transverse edges. The base plate may be formed of wood, plastic, steel, or aluminum, and is preferably 8 to 12 inches long and 6 to 10 inches wide.

A back plate 18 having front 20 and rear 22 surfaces and bottom 21 and top 23 edges is also provided. The bottom edge 21 of the back plate 18 is adhered along the first transverse edge 15 of the bottom plate 18. It should be noted that it is contemplated that the back plate 18 might also be formed by bending the base plate 12 90° along its transverse axis.

A front plate 32 having a bottom 34 and top 36 edges and front 38 and rear 40 surfaces is also provided. The front plate 32 provides a front wall to the base. This is accomplished by adhering the bottom edge 34 of the front plate 32 to the second transverse edge 17 of the base bottom plate 12. It should be noted that it is contemplated that the back plate 32 might also be formed by bending the base plate 12 90° along its transverse axis. Thus, together the base plate 12 and upstanding back 18 and front 32 plates form a generally C-shaped base plate (FIGS. 1 and 2).

A center plate 24 having a bottom edge 26 and front 28 and rear 30 surfaces is also provided. The bottom edge 28 of the center 24plate is adhered to the top surface 16 of the base bottom plate 12 in parallel spaced apart relation between the front surface 22 of the back plate 18 and the rear surface 40 of the front plate 32. The center plate 24 may be adhered to the base plate 12 by any conventional means available, the adhering means depending on the material used to make the various base assembly 11 components.

The center plate 32 provides a front wall to the file folder compartment 78 formed by the back plate 18 and base plate 12. In a preferred embodiment the file folder compartment 78 is at least 5 inches wide and adapted to removably support a plurality of conventional legal or letter sized file folders.

Additionally, the compartment 78 performs a dual function in that it also acts as a base in that the bottom surface 14 of the base bottom plate 12, beneath the compartment 78, acts to support a portion of the entire apparatus 10.

Mounted between the front plate 32 and the center plate 24 is a divider plate 42. The divider plate 42 has bottom 44 and top 46 edges and front 48 and 50 rear surfaces. The bottom edge 44 of the divider plate 42 is adhered to the top surface 16 of the base bottom plate 12 in parallel spaced apart relation between the front surface 28 of the center plate 24 and the rear surface 40 of the front plate 32. The divider plate 24 may be adhered to the base plate 12 by any conventional means available, the adhering means depending on the material used to make the various base assembly 11 Components.

Mounted between the center plate 24 front surface 28 and the divider plate 42 rear surface 50 are at least two sub-compartment divider members 52. These members 52 are mounted in parallel spaced apart relation to each other and in perpendicular relation to the center 24 and divider 42 plates (FIG. 1). The organization compartments 80 formed in this way may be used for any task related item such as pens, pencils and the like.

Together the front surface 48 of the divider plate 42, the rear surface 40 of the front plate 32, and the top surface 16 of the base bottom plate 12 form a storage compartment adapted for larger conventional task related items such as staplers, scissors, and the like.

Mounted to the front surface 38 of the front plate 32 is a generally C-shaped diskette compartment plate 74. The compartment plate 74 together with a portion of the front surface 38 of the front plate 32 provides a storage compartment for computer diskettes.

A first end plate 54 having bottom 56 and top 58 surfaces and first 60 and second 62 side surfaces provides one side wall to the compartments. The opposing side wall is provided by a second end plate 64 having bottom 66 and top 68 surfaces and first 70 and second 72 side surfaces.

A dust cover 76 is also provided for covering at least the large and diskette compartments. Permanently fastened to the top surface 16 of the base bottom plate 12 and the rear surface 30 of the center plate 24 is a Verti-Cal support member support tube 82. The support tube 82 has an inside diameter slightly larger than the outside diameter of the guide tube 86. Together the guide tube 86 and arm member 88 form the vertical support assembly 84. The inside diameter of the guide tube 86 is slightly larger that the outside diameter of the arm member 88.

At the upper end of the guide tube 86 is a guide hole 94. A plurality of spaced apart set holes 96 are provided in the arm member 88. The length of the vertical support assembly 84 can be adjusted by changing the set hole 96 aligned with the guide hole 94. A pin 98 is provided to secure the support assembly 84 at a given length.

The arm member 88 has both upper 90 and lower 92 ends. The upper end 90 is formed into a ball 102 adapted to be rotatably secured within the ball joint assembly 100 cup 104. The cup 104 portion of the ball joint assembly 100 is secured to the back surface 110 of a document support plate 108 with conventional screw fasteners 106. Along the lower edge of the document support plate 108 is a lip 114 adapted to support papers and the like on the plate 108. The vertical support assembly 84 and the document support plate 108 may be removed from the Vertical support member support tube 82 and attached to a desk or the like by any conventional means such as a clamp or the like.

While the invention has been described with a certain degree of particularity, it is manifest that many changes may be made in the details of construction and the arrangement of components without departing from the spirit and scope of the disclosure. It is understood that the invention is not limited to the embodiments set forth herein for purposes of exemplification, but is to be limited only by the scope of the appended claims including the full range of equivalency to which each element thereof is entitled.

Thus, there has been shown and described an improved work station organizer and copyholder which accomplishes at least all of the stated objects.

I claim:

1. A work station organizer and copyholder having storage compartments for file folders and task related items, comprising:

a support base having a bottom surface and front and rear portions.

said front portion formed into at least one compartment open at its top adapted to secure task related items, and said rear portion having a bottom wall secured to and extended rearwardly from said front portion and an upstanding rear wall extended upwardly from said bottom wall such that said bottom wall and rear wall at least partially define a channel adapted to removably support file folders and the like, said channel having opposite open ends which are substantially unobstructed above said bottom wall so that the length of articles to be placed in said channel is not limited by the width of said rear portion; and a generally vertical support member having upper and lower end portions;

means for securing said lower end portion of said generally vertical support member to said support base;

a document support panel adapted to support copy and the like;

means for retaining copy on said document support panel; and means for securing said document support panel to said upper end portion of said generally vertical support member.

2. The work station organizer and copyholder of claim 1 further comprising means for adjusting the vertical height of said generally vertical support member substantially free of transverse movement thereof.

3. The work station organizer and copyholder of claim 2, wherein said means for adjusting the vertical height of said generally vertical support member is a telescoping joint.

4. The work station organizer and copyholder of claim 1, further comprising means for removably detaching said generally vertical support member from said support base.

5. The work station organizer and copyholder of claim 4, wherein said means for removably detaching said generally vertical support member from said support base comprises:

an upstanding support post attached to said support base adapted to removably receive the lower portion of said generally vertical support member.

6. The work station organizer and copyholder of claim 5, comprising means for removably securing said generally vertical support member to said upstanding support post.

7. The work station organizer and copyholder of claim 1, wherein said support base comprises:

a generally C-shaped base having, a bottom portion, a first upstanding member having front and rear surface, and a second upstanding member; and a center upstanding member having front and rear surfaces fixed to said bottom portion and in parallel spaced apart relation to said first and second upstanding members;

at least one divider member fixed to said bottom portion and in parallel spaced apart relationship between said second upstanding member and said center upstanding member;

a first side wall fastened in perpendicular relation to said center upstanding member, divider member, and second upstanding member; and a second side wall fastened in perpendicular relation to said center upstanding member, divider member, and second upstanding member so as to be in parallel spaced apart relation with said first side wall whereby said center upstanding member and first upstanding member form a channel adapted for removably supporting and securing file folders and the like and whereby said center upstanding member, divider member, and first and second side walls form at least two parallel compartments adapted to removably contain task related items such as computer diskettes.

8. The work station organizer and copyholder of claim 6, wherein said generally vertical support member is fastened to the rear surface of said center upstanding member and in spaced apart relation to the front surface of said first upstanding member.

9. The work station organizer and copyholder of claim 1, wherein said means for securing said lower end portion of said generally vertical support member to said support base comprises an upright sleeve adapted to telescopically receive said lower end portion therein.

10. The work station organizer and copyholder of claim 1, wherein means for rotatably securing said support panel to said upper end portion of said generally vertical support member is a ball and socket joint.

11. The work station organizer and copyholder of claim 1, wherein said means for securing said document support panel is operative to secure said document support panel to said upper end portion of said vertical support member for pivotal movement about at least two axes.

* * * * *